US007866191B2

(12) United States Patent
Turner et al.

(10) Patent No.: US 7,866,191 B2
(45) Date of Patent: Jan. 11, 2011

(54) CLOTHES WASHER WITH CLOTHING TRAP

(75) Inventors: George L. Turner, Stevensville, MI (US); Eric E. Chang, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1911 days.

(21) Appl. No.: 10/877,264

(22) Filed: Jun. 25, 2004

(65) Prior Publication Data

US 2005/0284191 A1 Dec. 29, 2005

(51) Int. Cl.
*D06F 33/00* (2006.01)

(52) U.S. Cl. ..... 68/12.06; 68/12.26; 68/131; 68/132

(58) Field of Classification Search ..... 68/12.06, 68/12.26, 131, 132
See application file for complete search history.

(56) References Cited

U.S. PATENT DOCUMENTS

| | | | | |
|---|---|---|---|---|
| 3,278,037 | A * | 10/1966 | Stelli et. al. | 210/363 |
| 3,481,162 | A * | 12/1969 | Ziegler | 68/4 |
| 5,031,426 | A * | 7/1991 | Wilson | 68/207 |
| 5,855,127 | A * | 1/1999 | Kohara et al. | 68/23.2 |
| 6,658,902 | B2 | 12/2003 | Southworth et al. | 68/23.2 |

* cited by examiner

*Primary Examiner*—Michael Cleveland
*Assistant Examiner*—Samuel A Waldbaum
(74) *Attorney, Agent, or Firm*—Clifton G. Green; Greer, Burns & Crain

(57) ABSTRACT

An automatic clothes washer having a clothes trap for reducing the likelihood that an article of clothing can escape from a wash basket during the spinning of the basket.

19 Claims, 6 Drawing Sheets

CLOTHES WASHER WITH CLOTHING TRAP

BACKGROUND OF THE INVENTION

1. Field of the Invention

The invention relates to clothes washers for automatically washing one or more clothing articles. More specifically, the invention relates to a clothes washer having a clothing trap to prevent an article of clothing from being expelled over the top of a wash basket during a spin operation.

2. Description of the Related Art

Automatic clothes washers are widely known and commonly used to wash a load of clothes comprising one or more clothing articles in accordance with a programmed wash cycle. Clothes washers of this type typically comprise a perforated basket located within an imperforate tub, with the basket being rotatable relative to the tub. The clothing is placed in the basket where the wash liquid is free to flow between the basket and the tub through the perforations. With this configuration, wash liquid can be extracted from the clothes through centrifugal force by rotating the basket. The centrifugal extraction is generally referred to as a spin step or the spinning of the clothes.

In a vertical axis clothes washers, the basket and tub both have an open top defined by corresponding upper edges. A balancing ring is normally mounted to the upper edge of the basket and is designed to retard off-axis rotation caused by an unbalanced load. A decorative tub shroud for hiding the balancing ring from view and preventing the user from accidentally placing clothes in the tub during loading extends from the upper edge of the tub, over the balancing ring, and terminates in the interior of the basket at a position radially inwardly of the balancing ring.

The off-axis rotation causes the basket to move radially relative to the axis of rotation, which, if great enough, can cause the balancing ring or basket to contact the shroud or the tub. To prevent such contact the basket and tub are sized such that there is a gap between the balancing ring and tub and shroud, which provides the basket with a range of motion about which it can rotate off-axis without contacting either the tub or shroud.

While the gap is beneficial in preventing contact between the basket and the tub or shroud, it is disadvantageous in that it provides an opening though which the clothing can escape the basket. Depending on the size of the clothes load and the spin speed, the centrifugal force can push the clothing to the exterior of the basket. As the clothing piles up against the basket, it also pushes upwardly along the basket side wall. Under the right conditions, an article of clothing can be pushed over the top of the basket and out the gap where it can fall into the tub. Once in the tub, the article of clothing can be drawn into the pump inlet, which is normally fluidly connected to the tub, where it can clog and damage the pump.

It is desirable to have a clothes washer that can accommodate the off-axis rotation of the basket while preventing the escape of an article of clothing through the gap between balancing ring and the guard.

SUMMARY OF THE INVENTION

The invention relates to an automatic clothes washer. The clothes washer comprises a cabinet defining an interior and having a top defining a loading opening providing access to the cabinet interior. Within the cabinet is positioned a a tub comprising a bottom wall and a peripheral wall extending upwardly from the bottom wall, with the peripheral wall terminating in an upper edge to define an open top for the tub.

Within the tub is positioned a basket comprising a bottom wall and a peripheral wall extending upwardly from the bottom wall, with the peripheral wall terminating in an upper edge to define an open top for the basket. A balancing ring is mounted to the upper edge of the basket and a shroud overlies the balancing ring and terminates in a peripheral edge that extends radially inwardly of the balancing ring such that the peripheral edge axially overlaps the balancing ring to define a radial gap between the peripheral edge and the balancing ring. A clothes trap is mounted to the balancing ring and has a barrier flange that extends into the radial gap, wherein the barrier flange effectively reduces the radial gap and stops articles of clothing from passing through the radial gap during a spinning operation of the basket.

The barrier flange can partially define a volume below the barrier flange. The volume being used to receive at least a portion of an article of clothing. The barrier flange can also terminate in a terminal edge that is located axially above the peripheral edge of the shroud.

One of the balancing ring and the clothes trap comprises multiple projections and the other of the balancing ring and clothes trap comprises multiple apertures, and the projections are received within the apertures to mount the clothes trap to the balancing ring. A mechanical connection connects the projections to the other of the balancing ring and clothes trap. The mechanical connection is formed by one of heat staking or welding the projections to the other of the balancing ring and clothes trap.

The clothes trap is preferably continuous about the balancing ring. Preferably, the radial gap has a nominal dimension of less than 12.50 mm and the barrier flange extends 7.5-15 mm beyond the balancing ring.

The barrier flange can have different shapes but is preferably substantially straight. The barrier flange also extends substantially perpendicularly to the basket peripheral wall. Preferably, any portion of the barrier flange extending radially interiorly of the balancing ring is substantially perpendicular to the peripheral wall of the basket.

The shroud can be sized such that it hides the balancing ring from view through the loading opening.

DESCRIPTION OF THE INVENTION

Figure 1:
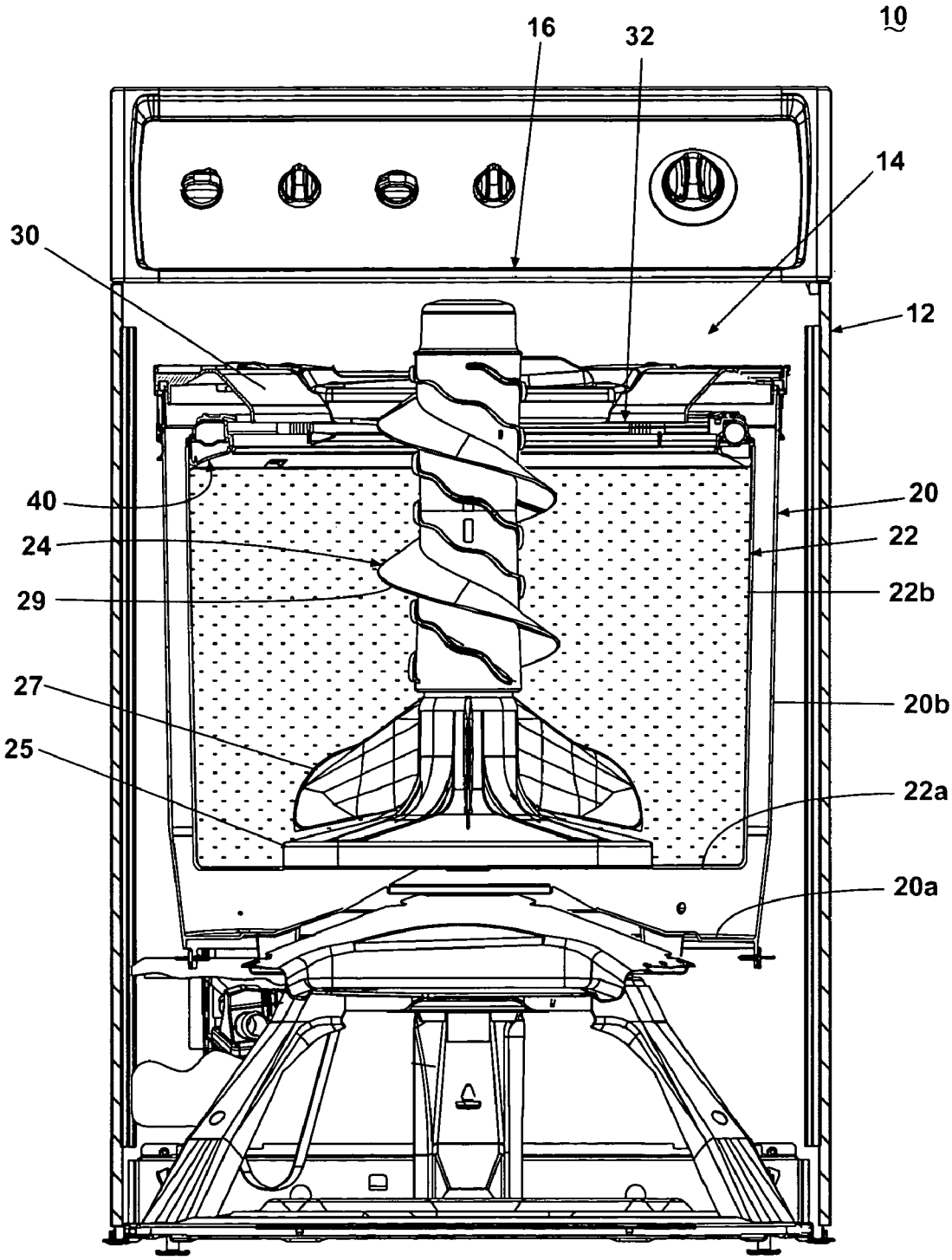
FIG. 1 is a front sectional view of an automatic clothes washer with a clothes trap according to the invention.

Referring to FIG. 1, there is shown a clothes washer 10 providing an illustrative environment for the invention. As illustrated, the clothes washer 10 is a vertical axis clothes washer comprising an exterior cabinet 12 defining an interior 14 accessible through an opening 16 in the top of the cabinet 12, which is normally closed by a door (not shown) hingedly mounted to the cabinet 12. An imperforate tub 20 and a perforated basket 22 are located within the interior 14 of the cabinet 12. The tub 20 and basket 22 are mounted in the cabinet 12 in a traditional manner such that the basket 22 can rotate relative to the tub 20.

Each of the tub 20 and basket 22 comprise a closed bottom 20*a*, 22*a* and a peripheral wall 20*b*, 22*b*, extending upwardly from the corresponding bottom 20*a*, 22*a* and terminating in an upper edge 20*c*, 22*c*, which defines an open top. The peripheral walls 20*b* and 22*b* are preferably cylindrical resulting in the open top having a circular shape.

A wash liquid system (not shown) is commonly used to introduce wash liquid onto clothing placed in the basket 16. The wash liquid can comprise water or a mixture of water with wash aid, such as detergent. The wash liquid system normally comprises a wash aid dispenser and a water inlet along with a pump coupled to the tub for draining or recirculating wash liquid from the tub. The type of wash system is not germane to the invention. There are many well known wash systems. One common type of wash system is the immersion type which at least partially fills the basket 16 and tub 14 with wash liquid to clean the clothes while they are immersed in the wash liquid. Another common wash system is a reciprocating wash liquid system that reciprocates wash liquid through the clothing. Some systems are capable of both immersion and reciprocation, with the selection of a particular method being dependent on a particular wash cycle.

An agitator 24 is provided within the basket 22 and rotates relative to the basket 22 to aid in cleaning the clothing. The agitator 24 is illustrated as a the well known combination of a reciprocating skirt 25 with vanes 27 and an auger 29, which is more commonly used with immersion type wash liquid systems. However, the type of agitator is not germane to the invention. Any suitable type of agitator can be used. For example, an impeller or nutating plate can be used in place of the reciprocating auger. Each of the agitator types can be used with all of the wash liquid systems.

Figure 2:
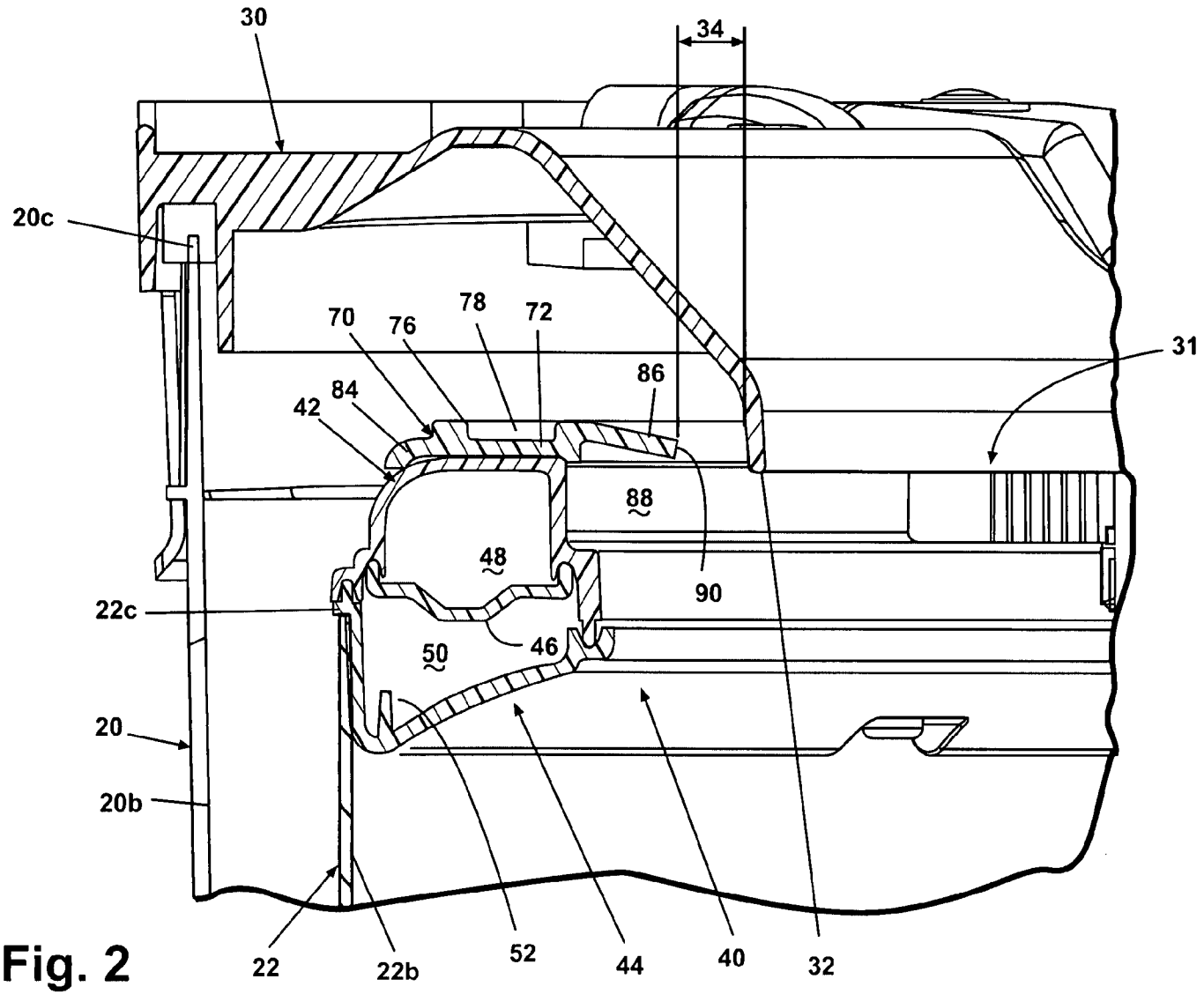
FIG. 2 is an enlarged sectional view of the clothes washer of FIG. 1 and illustrating the relationship between the tub, basket, balancing ring and trap.

Referring to FIGS. 1 and 2, a shroud 30 is mounted to and extends from the upper edge 20*c* of the tub 20. The shroud 30 defines an opening 31 that is aligned with the cabinet opening 16. The shroud 30 extends over and beyond the basket 22 and terminates radially internally of the basket 22 at terminal end 32. The shroud 30 performs multiple functions. It prevents wash liquid from running up the walls of the tub 20 and basket 22 and splashing out. Any wash liquid running up the walls of the tub 20 and basket 22 will ultimately encounter the splash guard, which will redirect the wash liquid back into the tub 20 and/or basket 22. The shroud also acts as a decorative cover and hides the upper ends 20*c*, 22*c* of the tub 20 and basket 22. Another function is to prevent access by the user to the upper ends of the tub 20 and basket 22 when the door is opened, which prevents the user from accidentally placing clothing in the tub 20 when loading clothes in the basket 22.

A balancing ring 40 is mounted to the upper end of the basket 22 and functions to dampen the off-axis rotation of the basket 22, especially during the spinning of the basket 22. A clothes trap 70 is mounted to and extends from the balancing ring 40. The terminal end 32 of the shroud 30 axially overlaps with the balancing ring 40. The extent of the shroud 30 such that it axially overlaps the balancing ring 40 aids the shroud 30 in its intended functions. The axial overlap of the shroud 30 and balancing ring 40 also defines a radial gap 34 between the shroud 30 and the clothes trap 70. As illustrated, the nominal radial gap 34 is approximately 12.50 mm.

Figure 3:
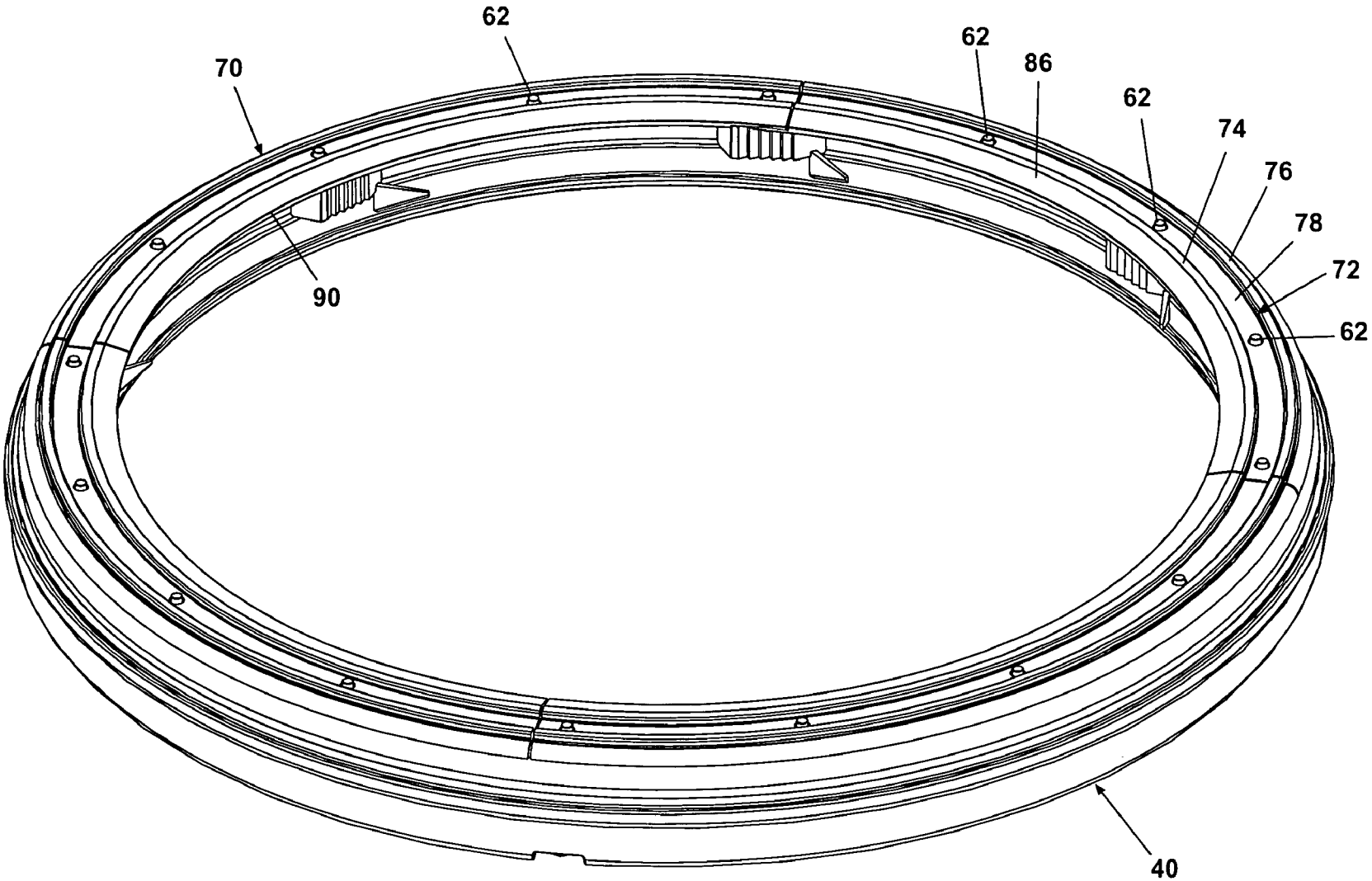
FIG. 3 is a perspective view of the balancing ring and trap.
Figure 4:
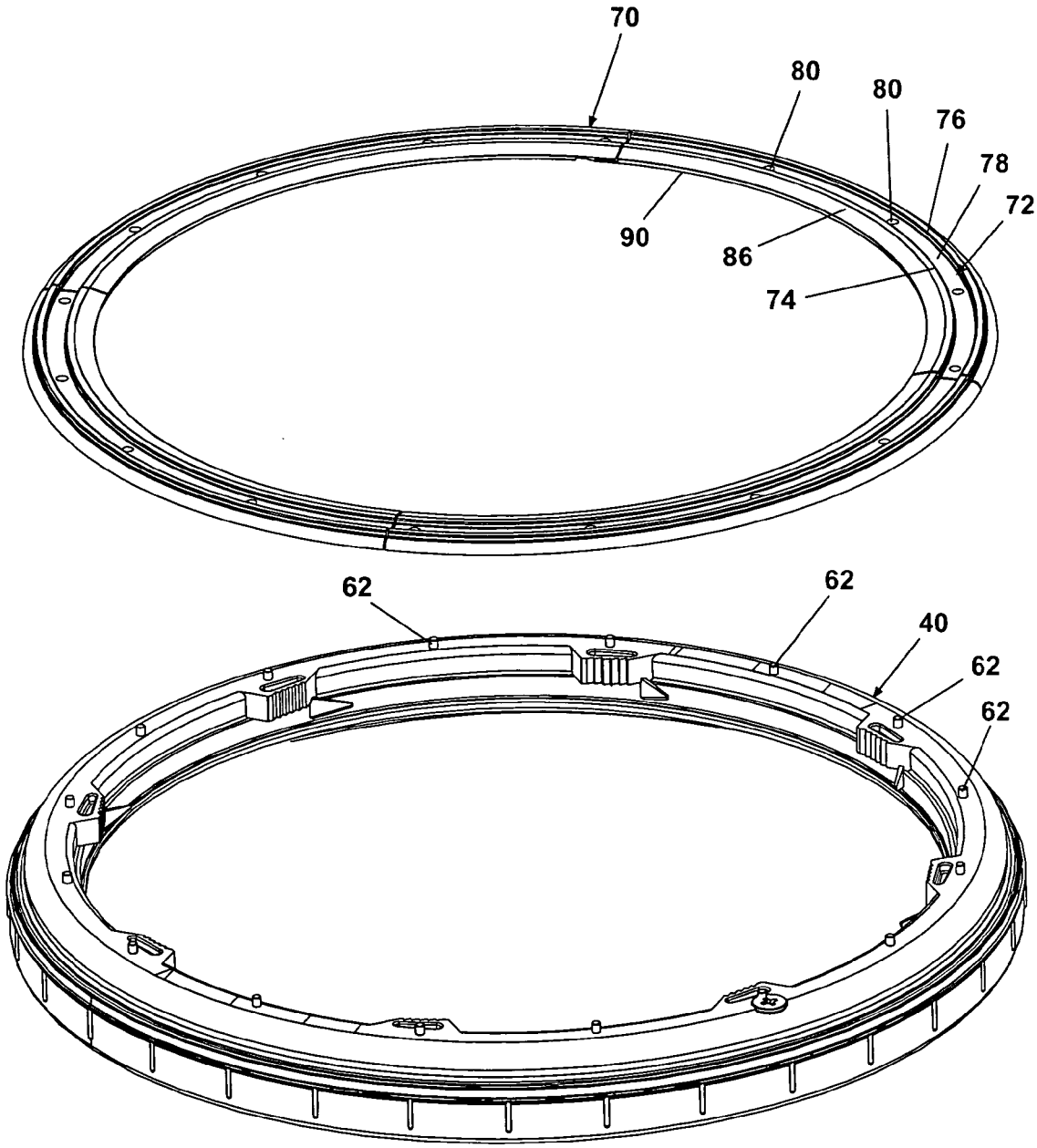
FIG. 4 is an exploded view of the balancing ring and trap.
Figure 5:
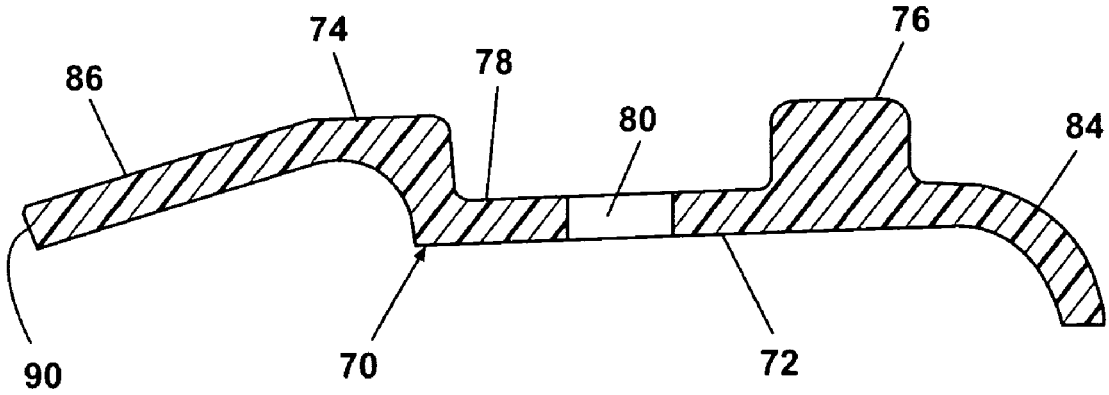
FIG. 5 is an enlarged cross section of the trap.

Referring to FIGS. 2-4, the balancing ring 40 comprises lower and upper channel members 42, 44 arranged in a confronting relationship to a dividing wall 46 to collectively form lower and upper annular chambers 48, 50. Multiple, spaced embossments 62 extend from the upper channel member 42. The lower chamber 48 is partially filled with a first fluid, such as water. The upper chamber 50 is partially filled with a second fluid, such as a light-weight oil, having a higher viscosity than the first fluid. Weighted balls (not shown) are also placed within the upper chamber 50. The first fluid is free to flow within the lower chamber 48, except that baffles 52 are located periodically within the lower chamber 48 to slow down, but not prevent the free flow of the first fluid. The second fluid and weighted balls are free to flow around the upper chamber 50.

With this configuration, the first fluid, second fluid, and weighted balls flow about the corresponding chamber 48, 50 to balance any out-of-balance condition and retard the off-axis rotation. Such a dual chamber balancing ring is shown and described in greater detail in U.S. Pat. No. 6,658,902, which is incorporated by reference. Other types of balancing rings can be used.

Referring to FIGS. 2-5, a clothes trap 70 is mounted to and extends from the balancing ring 40. The trap 70 preferably comprises an annular base 72 from which extend a pair of spaced, concentric ribs 74, 76, which define a channel 78 therebetween. A series of openings 80 are located in the channel and extend through the base 72. An arcuate flange 84 extends from the radially exterior of the base 72. The arcuate shape is selected to conform with the corresponding shape of the balancing ring 40. A barrier flange 86 extends radially inwardly from the base 72. More specifically, the barrier flange 86 extends from the rib 74. The barrier flange 86 is preferably substantially straight in cross section.

The trap 70 is mounted to the balancing ring 40 by placing the trap 70 on the balancing ring 40 such that the projections 62 are received within the openings 80. A mechanical connection is then formed between the projections 62 and the trap 70, preferably by heat staking or welding the projections 62 to the trap 70.

When the trap 70 is mounted to the balancing ring 40, for the preferred embodiment, the barrier flange 86 extends 7.5 to 15 mm beyond the balancing ring 40. It should be noted that the radial extent of the barrier flange 86 is limited in that it should not extend so far as to contact the shroud during off-axis rotation. However, the barrier flange 86 does need to extend radially a distant sufficient to block any clothing article from sliding up the basket peripheral wall and escaping through the gap 34. It is worth noting that the barrier flange 86 extends a sufficient distance away from the balancing ring 40 that the barrier flange 86 defines a partially enclosed volume 88 (FIG. 2) beneath the barrier flange 86, with the barrier flange 86 forming the axial limit of the volume and the balancing ring 40 forming the radial limit of the volume. It is further worth noting that the barrier flange 86, especially a terminal edge 90 of the barrier flange 86, is axially overlapped with the peripheral edge 32 of the shroud 30, which ensures that an article of clothing must pass over the barrier edge 86 to escape the basket. This configuration effectively forms a labyrinth-type passage that the article of clothing must pass to escape. In this way, the trap 70 makes it unlikely that an article of clothing can exit the gap 34.

Another advantage of the balancing ring 40 and trap 70 configuration that may not be immediately recognizable is that the trap 70 is not integrally formed with the balancing ring. Most manufactures of automatic clothes washers have multiple models. It is desirable for as many parts as possible to be shared between models. However, not all models may need the clothes trap, whereas most models will need a balancing ring. Even for those models that require a trap, the radial extent of the trap may not be the same. Making the trap 70 separate from the balancing ring 40 while providing a simple means of mounting the trap 70 to the balancing ring, makes it easy for the manufacture to add the trap 70 to the models as needed without having to keep separate inventories of balancing rings 40 if the trap were integrally formed with the balancing ring.

Figure 6:
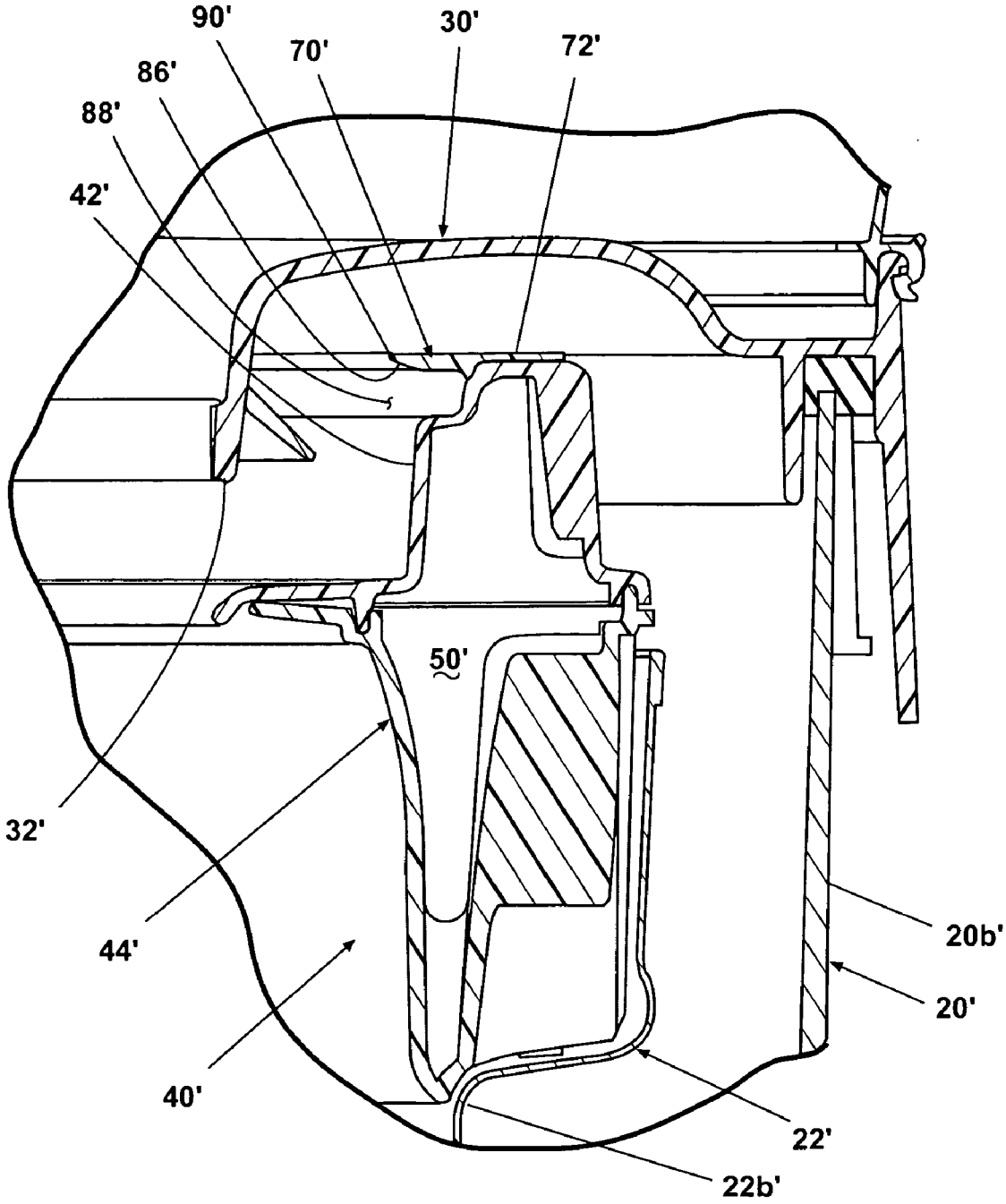
FIG. 6 is an enlarged cross section similar to FIG. 2 illustrating an alternative balancing ring and trap.

FIG. 6 illustrates an alternative trap 70' mounted to a single chamber balancing ring 40'. The structures of the alternative trap 70' and balancing ring 40' are generally similar to those previously described. Therefore, similar parts will be identified with the same number using the prime suffix. The alternative trap 70' is identical to the trap 70 in that it has openings that receive projections to mount the trap 70' to the upper channel member 42' of the balancing ring 40'. The alternative trap 70' differs in that the base 72' is substantially flat, both on the upper and lower surface and the barrier flange 86' extends perpendicularly relative to the side wall 22*b'* of the basket.

While the invention has been specifically described in connection with certain embodiments thereof, it is to be understood that this is by way of illustration and not of limitation, and the scope of the appended claims should be construed as broadly as the prior art will permit.

What is claimed is:

1. An automatic clothes washer comprising:

a cabinet defining an interior and having a top defining a loading opening providing access to the cabinet interior;

a tub located within the cabinet interior, the tub comprising a bottom wall and a peripheral wall extending upwardly from the bottom wall, with the peripheral wall terminating in an upper edge to define an open top for the tub;

a basket located within the tub, the basket comprising a bottom wall and a peripheral wall extending upwardly from the bottom wall, with the peripheral wall terminating in an upper edge to define an open top for the basket;

a balancing ring mounted to the upper edge of the basket;

a shroud overlying the balancing ring and terminating in a peripheral edge that extends radially inwardly of the balancing ring such that the peripheral edge axially overlaps the balancing ring to define a radial gap between the peripheral edge and the balancing ring; and a clothes trap mounted to the balancing ring and having a barrier flange that extends into the radial gap, wherein the barrier flange effectively reduces the radial gap and stops articles of clothing from passing through the radial gap during a spinning operation of the basket.

2. The automatic clothes washer according to claim 1, wherein one of the balancing ring and the clothes trap comprises multiple projections and the other of the balancing ring and clothes trap comprises multiple apertures, and the projections are received within the apertures to mount the clothes trap to the balancing ring.

3. The automatic clothes washer according to claim 2, and comprising a mechanical connection connecting the projections to the other of the balancing ring and clothes trap.

4. The automatic clothes washer according to claim 3, wherein the mechanical connection is formed by one of heat staking, or welding the projections to the other of the balancing ring and clothes trap.

5. The automatic clothes washer according to claim 1, wherein the clothes trap is continuous.

6. The automatic clothes washer according to claim 1, wherein the radial gap has a nominal dimension of less than 12.50 mm.

7. The automatic clothes washer according to claim 6, wherein the barrier flange extends 7.5 to 15 mm beyond the balancing ring.

8. The automatic clothes washer according to claim 7, wherein the barrier flange defines an axial limit of a partially enclosed volume within the basket.

9. The automatic clothes washer according to claim 8, wherein the barrier flange is substantially straight.

10. The automatic clothes washer according to claim 9, wherein the barrier flange is oriented at an arcuate angle to the peripheral wall of the basket.

11. The automatic clothes washer according to claim 1, wherein the barrier flange terminates in a terminal edge that is located axially above the peripheral edge of the shroud.

12. The automatic clothes washer according to claim 11, wherein the barrier flange is substantially perpendicular to the peripheral wall of the basket.

13. The automatic clothes washer according to claim 12, wherein any portion of the barrier flange extending radially interiorly of the balancing ring is substantially perpendicular to the peripheral wall of the basket.

14. The automatic clothes washer according to claim 13, wherein the shroud hides the balancing ring from view through the loading opening.

15. The automatic clothes washer according to claim 14, wherein one of the balancing ring and the clothes trap comprises multiple projections and the other of the balancing ring and clothes trap comprises multiple apertures, and the projections are received within the apertures to mount the clothes trap to the balancing ring.

16. The automatic clothes washer according to claim 15, and comprising a mechanical connection connecting the projections to the other of the balancing ring and clothes trap.

17. The automatic clothes washer according to claim 16, wherein the mechanical connection is formed by one of heat staking, or welding the projections to the other of the balancing ring and clothes trap.

18. The automatic clothes washer according to claim 1, wherein the barrier flange defines an axial limit of a partially enclosed volume within the basket.

19. The automatic clothes washer according to claim 18, wherein the barrier flange terminates in a terminal edge that is located axially above the peripheral edge of the shroud.

* * * * *